US008319408B1

(12) United States Patent
Horng

(10) Patent No.: US 8,319,408 B1
(45) Date of Patent: Nov. 27, 2012

(54) LED LAMP WITH SIMPLIFIED STRUCTURE

(75) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 13/157,716

(22) Filed: Jun. 10, 2011

(30) Foreign Application Priority Data

May 23, 2011 (TW) ..... 100118024

(51) Int. Cl.
*H01J 61/52* (2006.01)
*F21V 29/00* (2006.01)

(52) U.S. Cl. ..... 313/46; 362/373; 362/234; 362/546; 362/547

(58) Field of Classification Search ..... 313/46; 362/547, 294
See application file for complete search history.

(56) References Cited

U.S. PATENT DOCUMENTS

| | | | | |
|---|---|---|---|---|
| 7,144,135 | B2 * | 12/2006 | Martin et al. | 362/294 |
| 2008/0212333 | A1 * | 9/2008 | Chen | 362/373 |
| 2009/0046473 | A1 * | 2/2009 | Tsai et al. | 362/373 |
| 2010/0020537 | A1 * | 1/2010 | He et al. | 362/234 |

FOREIGN PATENT DOCUMENTS

| | | | |
|---|---|---|---|
| CN | 201531790 | U * | 7/2010 |
| TW | 346745 | | 12/2008 |
| TW | I316121 | B1 | 10/2009 |
| TW | 372927 | | 1/2010 |
| TW | I334528 | B1 | 12/2010 |

OTHER PUBLICATIONS

Machine English translation of CN 201531790 to Zhu.*

* cited by examiner

*Primary Examiner* — Sikha Roy
(74) *Attorney, Agent, or Firm* — Muncy, Geissler, Olds & Lowe, PLLC

(57) ABSTRACT

A lamp includes a housing, a cooling module and a light emitting diode. The housing has an assembling opening and an electrical connection member on two ends of the housing, wherein an inner surface of the housing defines a receiving room, and a part of the inner surface of the housing adjacent to the assembling opening is an air-guiding wall. The cooling module is disposed at the assembling opening of the housing to form at least one air channel between the cooling module and the air-guiding wall, wherein the cooling module has an air-guiding passage communicating with the receiving room of the housing. The light emitting diode is coupled with the cooling module. Therefore, there is no air inlet or outlet formed on the housing of the LED lamp, so as to provide a simplified structure and to maintain the exterior integrity of the LED lamp.

8 Claims, 5 Drawing Sheets

LED LAMP WITH SIMPLIFIED STRUCTURE

BACKGROUND OF THE INVENTION

1. Field of the Invention

The present invention generally relates to a LED lamp and, more particularly, to a LED lamp with a cooling module.

2. Description of the Related Art

Referring to FIG. 1, Taiwanese Patent No. 1316121 discloses a conventional LED lamp 8 with a housing 81. The conventional LED lamp 8 consists of a first housing 811 and a second housing 812. The first housing 811 has an air outlet 811*a* and the second housing 812 has an air inlet 812*a*. The housing 81 has a heat sink 82, a light-emitting element 83 and a cooling fan 84, with the heat sink 82 disposed between the light-emitting element 83 and the cooling fan 84. Based on the structure, the cooling fan 84 may draw the external air into the conventional LED lamp 8 via the air inlet 812*a*. The drawn air will travel through the heat sink 82 and be expelled from the conventional LED lamp 8 via the air outlet 811*a*. Thus, heat generated by the light-emitting element 83 can be dissipated.

However, since the housing 81 consists of at least two housings (first and second housings 811 and 812), more components are used and the overall structure of the conventional LED lamp 8 is more complex. In addition, the conventional LED lamp 8 requires forming a plurality of holes on the housing 81 as the air outlet 811*a* and the air inlet 812*a*, it will be more difficult to manufacture the conventional LED lamp 8. This results in an increment in manufacturing costs.

Besides, the conventional LED lamp 8 should be partially inserted into a decorative ceiling consisting of a plurality of ceiling panels for aesthetic consideration. Therefore, the air outlet 811*a* and the air inlet 812*a* will be settled into a confined space above the decorative ceiling where the ventilation is poor. As a result, the heat of the LED lamp will accumulate in the confined space, shortening the service life of the conventional LED lamp 8.

Referring to FIG. 2, Taiwanese Patent No. M346745 discloses another conventional LED lamp 9 comprising a housing 91, a heat sink 92, a fan 93 and a light-emitting diode (LED) unit 94. The housing 91 consists of an upper housing 911 and a lower housing 912. The upper housing 911 has a plurality of vents 911*a* and the lower housing 912 has a through hole 912*a*. The heat sink 92 is disposed in the housing 91, with an air channel 95 formed between the heat sink 92 and the through hole 912*a* of the lower housing 912. The fan 93 is also disposed in the housing 91 and coupled with the heat sink 92. The LED unit 94 is coupled with the heat sink 92. In such an arrangement, the external air can be drawn into the conventional LED lamp 9 via the vents 911*a* and the air inside the conventional LED lamp 9 can be expelled via the through hole 912*a*, thereby dissipating the heat generated by the LED unit 94.

However, the conventional LED lamp 9 also contains two housings (the upper and lower housings 911 and 912) and therefore has larger component consumption and more complex structure. Furthermore, the conventional LED lamp 9 still requires forming the vents 911*a* on the upper housing 911 even though the air channel 95 has been provided between the heat sink 92 and the through hole 912*a*. Therefore, the conventional LED lamp 9 has the same drawbacks of inconvenient processing and high manufacturing costs as the conventional LED lamp 8. When the conventional LED lamp 9 is partially inserted into the decorative ceiling, the vents 911*a* are still settled into the confined space above the decorative ceiling although the air channel 95 is located outside the confined space beneath the decorative ceiling for better air convection. Thus, the conventional LED lamp 9 still has poor cooling efficiency, which shortens the service life thereof.

SUMMARY OF THE INVENTION

It is therefore the primary objective of this invention to provide a LED lamp which does not require forming any air inlet or outlet on a housing thereof. Thus, the LED lamp has a simplified structure and is easy for manufacture.

It is another objective of this invention to provide a LED lamp which does not have any air inlet or outlet on a housing thereof so as to maintain the exterior integrity of the LED lamp.

It is another objective of this invention to provide a LED lamp which ensures the external air to flow into and out of the LED lamp smoothly when the LED lamp is partially inserted into a decorative ceiling. Thus, the LED lamp has better heat dissipation efficiency and can operate normally.

The invention discloses a LED lamp including a housing, a cooling module, and a light emitting diode. The housing has an assembling opening and an electrical connection member on two ends of the housing, wherein an inner surface of the housing defines a receiving room, and a part of the inner surface of the housing adjacent to the assembling opening is an air-guiding wall. The cooling module is disposed at the assembling opening of the housing to form at least one air channel between the cooling module and the air-guiding wall, wherein the cooling module has an air-guiding passage communicating with the receiving room of the housing. The light emitting diode is coupled with the cooling module. Besides, the at least one air channel is at least one radial inlet and the air-guiding passage is a radial outlet, or the at least one air channel is at least one radial outlet and the air-guiding passage is a radial inlet. Alternatively, the at least one air channel is at least one radial inlet and the air-guiding passage is an axial outlet, or the at least one air channel is at least one radial outlet and the air-guiding passage is an axial inlet.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
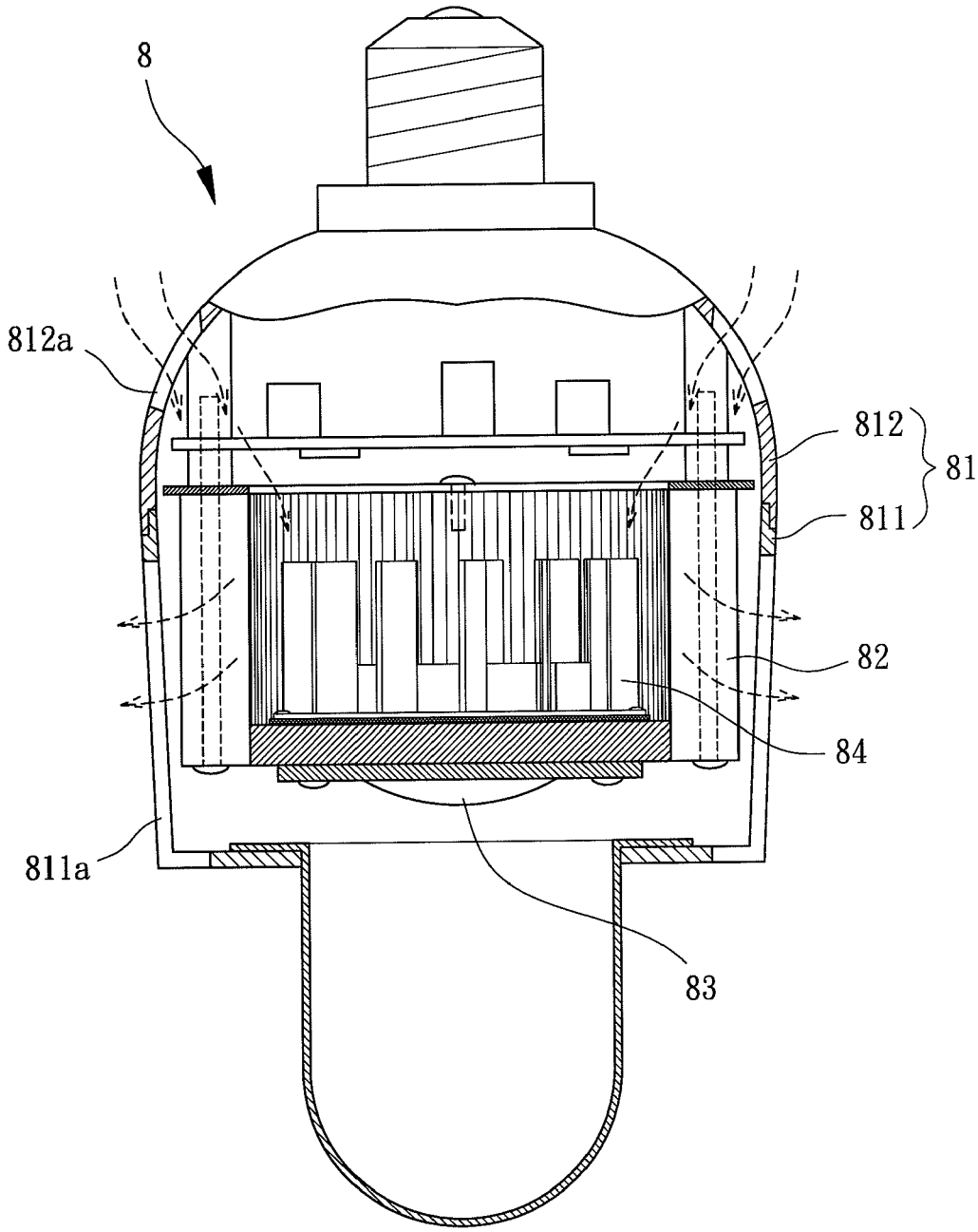
FIG. 1 PRIOR ART
FIG. 1 shows a cross-sectional view of a conventional LED lamp.
Figure 2:
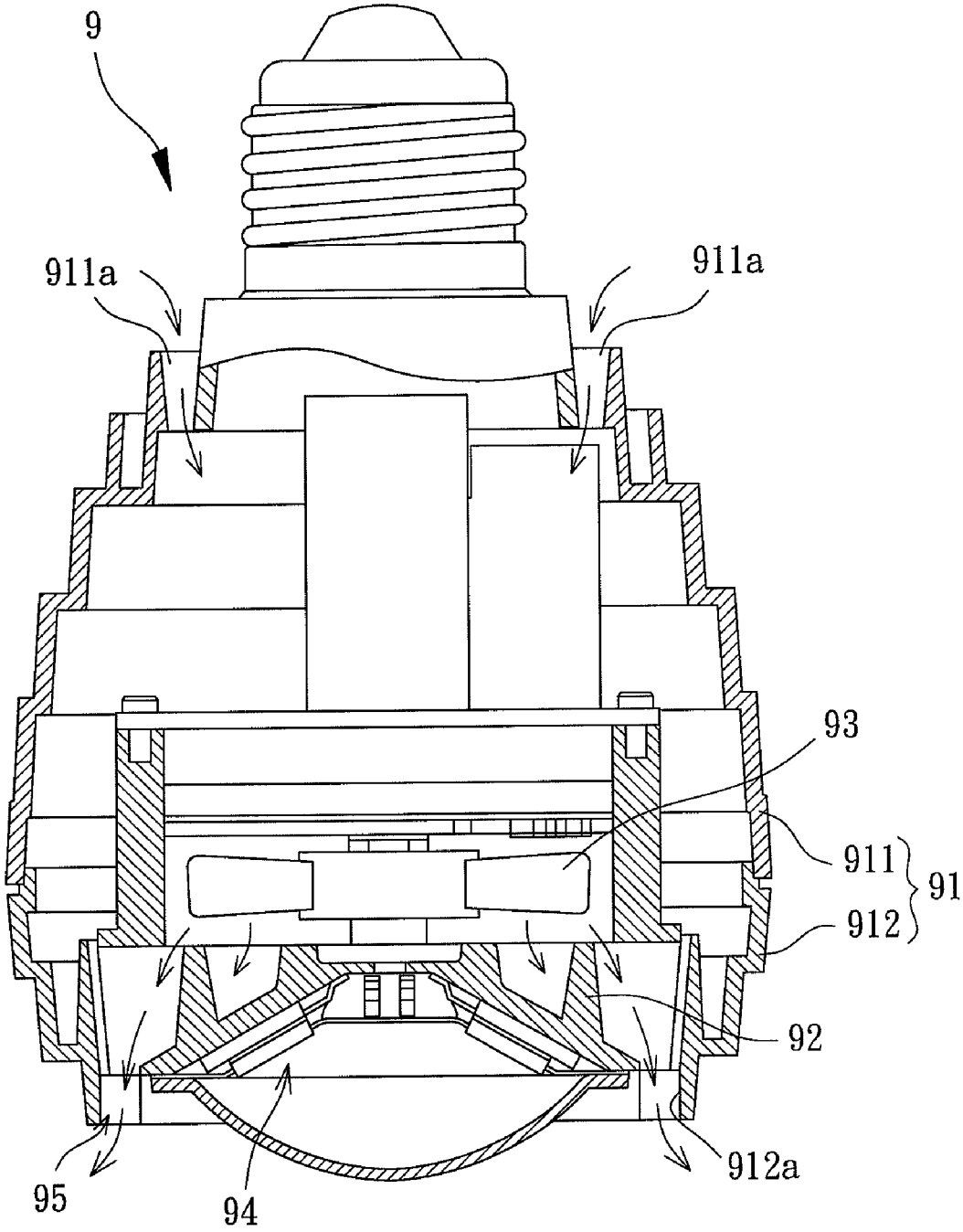
FIG. 2 PRIOR ART
FIG. 2 shows a cross-sectional view of another conventional LED lamp.

In the various figures of the drawings, the same numerals designate the same or similar parts. Furthermore, when the term "inner," "outer," "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
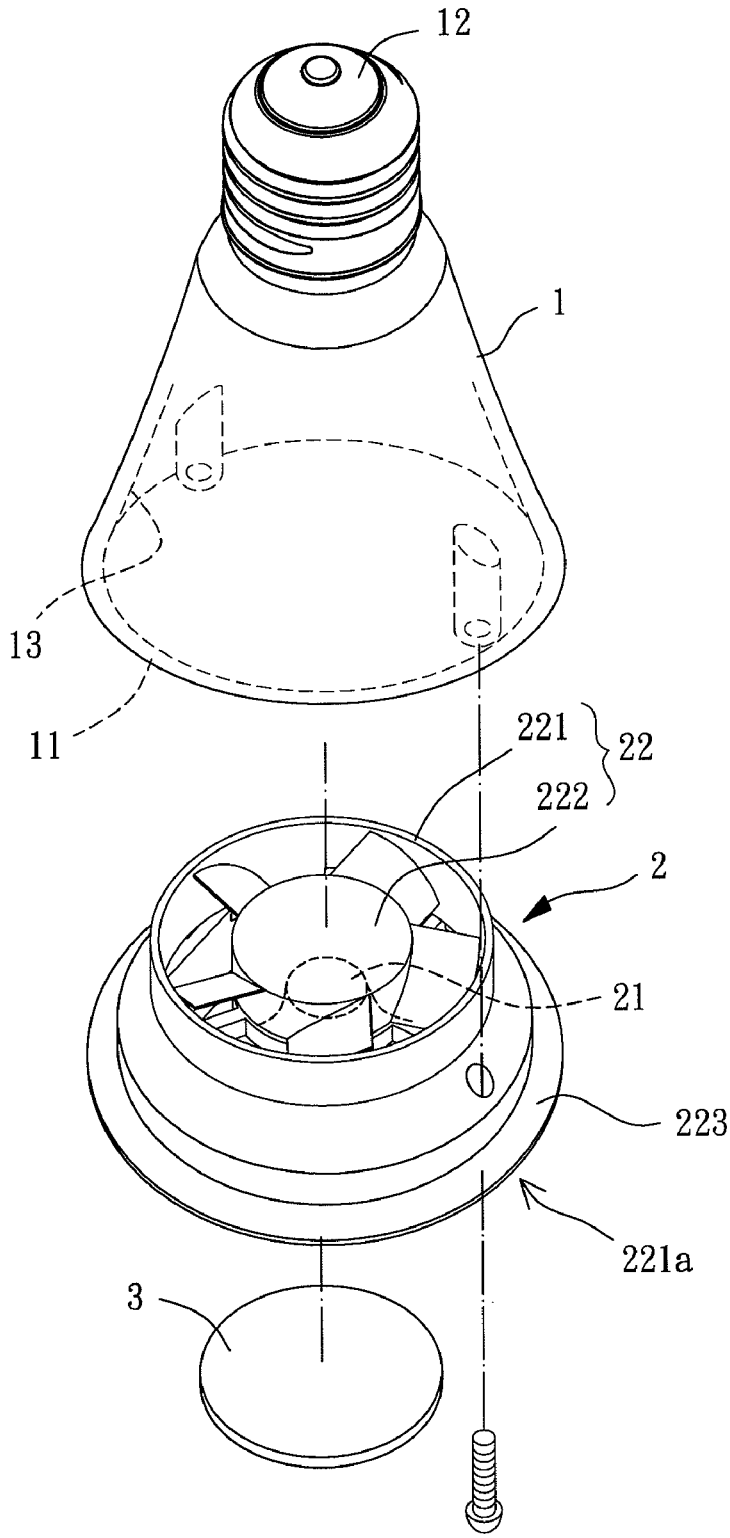
FIG. 3 shows an exploded and perspective view of a "radial inlet and radial outlet" type of a LED lamp according to a preferred embodiment of the invention.
Figure 4:
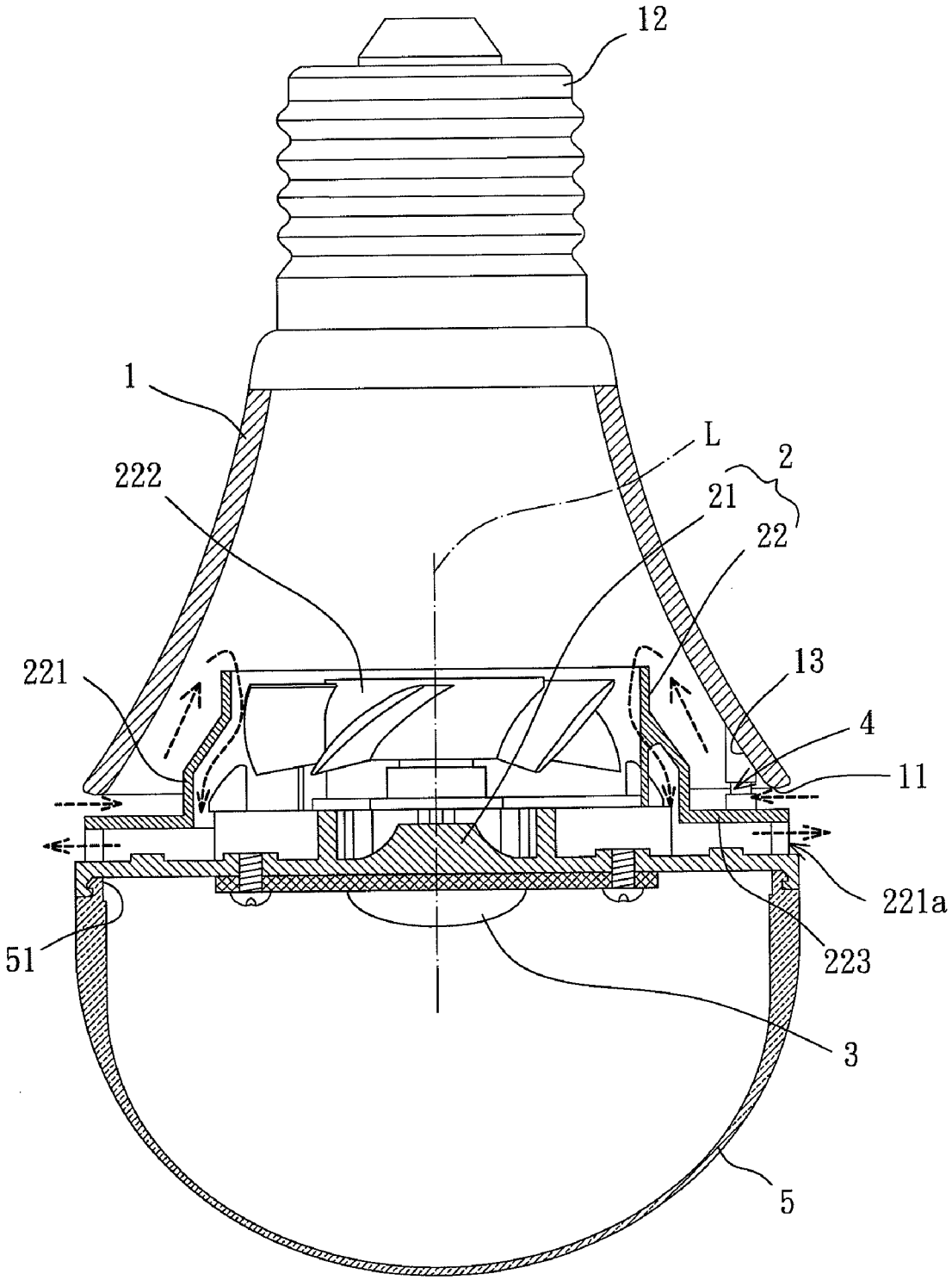
FIG. 4 shows a cross-sectional view of the "radial inlet and radial outlet" type of the LED lamp according to the preferred embodiment of the invention.

Referring to FIGS. 3 and 4, the invention discloses a LED lamp having a housing 1, a cooling module 2 and a light emitting diode 3 at least. The housing 1 is provided to receive the cooling module 2, and the light emitting diode 3 is coupled with the cooling module 2.

The housing 1 is a hollow housing having an assembling opening 11 on one end and an electrical connection member 12 on another end. The assembling opening 11 communicates with a receiving room defined by an inner surface of the housing 1, so that the cooling module 2 can be disposed into the receiving room of the housing 1 via the assembling opening 11. Besides, a part of the inner surface of the housing 1 adjacent to the assembling opening 11 is defined as an air-guiding wall 13 hereinafter. The electrical connection member 12 is in any form capable of providing electrical connection to an external power supply.

The cooling module 2 is disposed inside the housing 1, with at least one air channel 4 formed between the cooling module 2 and the air-guiding wall 13 of the housing 1 to allow air inhalation or exhaust. Combination between the cooling module 2 and the housing 1 may be achieved by conventional ways such as threading coupling, elastic engagement, agglutination, and welding.

Specifically, the cooling module 2 may includes a heat sink 21 and a cooling fan 22. The heat sink 21 is made of material with good performance in heat conductivity. The cooling fan 22 is coupled with the heat sink 21 and may be an axial flow fan or centrifugal fan, with the axial flow fan preferred. Thereby, with the heat sink 21, the cooling fan 22 may provide a preferable cooling efficiency. Besides, an outer periphery of either heat sink 21 or cooling fan 22 can be used to define the at least one air channel 4 with the air-guiding wall 13 of the housing 1.

The light emitting diode 3 is coupled with the cooling module 2 for the cooling module 2 to efficiently reduce the operation temperature of the light emitting diode 3. The light emitting diode 3 is electrically connected with the electrical connection member 12 of the housing 1 to receive electrical power provided by the external power supply.

When the LED lamp of the invention is in use, the LED lamp can be installed in places where illumination is required, such as wall, ceiling and so on. As an example, the housing 1 of the LED lamp can be partially inserted into the decorative ceiling in a way that the assembling opening 11 and the light emitting diode 3 are located outside the confined space beneath the decorative ceiling. In addition, since the at least one air channel 4 is formed between the cooling module 2 and the air-guiding wall 13 adjacent to the assembling opening 11, the at least one air channel 4 is allowed to locate beneath the decorative ceiling. When the cooling fan 22 of the cooling module 2 rotates, air can be drawn into or exhausted from the housing 1 by the air channel 4 so as to dissipate heat generated by the light emitting diode 3. Besides, the light emitting diode 3 may emit light once the electrical connection member 12 is supplied with electrical power.

Based on the disclosed structure of the LED lamp, the LED lamp of the invention is characterized in forming the air channel 4 by a space between the assembling opening 11 and the cooling module 2. Therefore, the assembling opening 11 that has already been constructed for assembling purpose can be taken as inlet and outlet of the LED lamp of the invention, so as to omit the need of forming any additional air inlet or outlet on the housing 1. As an advantage, the overall structural complexity and costs are reduced and the manufacturing convenience is improved. Furthermore, when the LED lamp of the invention is partially inserted into the decorative ceiling, the air channel 4 can locate outside the confined space beneath the decorative ceiling. Based on the design, the cooling module 2 can smoothly guide the air to flow into and out of the LED lamp, thereby improving the overall heat dissipation efficiency and prolonging the service life of the LED lamp.

Based on the structural design of the LED lamp of the invention, with arranging the air channel 4 in different ways, the LED lamp of the invention may be designed to form one of a "radial inlet and radial outlet" type and an "axial inlet and radial outlet" type, which can also be performed as a "radial inlet and axial outlet" type if the air is driven to flow in a reverse direction, between the housing 1 and the cooling module 2.

Referring to FIG. 4, the said "radial inlet and radial outlet" type of the LED lamp is shown. In order to further illustrate in detail, a reference axial line "L" is defined and shown in FIG. 4. Specifically, the reference axial line "L" is an axial line of the cooling fan 22 of the cooling module 2, with the cooling fan 22 including a frame 221, a fan wheel 222, and a radial extending member 223. The frame 221 receives the fan wheel 222 driven by a motor and able to revolve around the reference axial line "L," while a bottom of the frame 221 forms the radial extending member 223 extending in radial directions of the reference axial line "L," which are perpendicular to the reference axial line "L." Accordingly, the air channel 4 is formed between the radial extending member 223 and the air-guiding wall 13 as well as by the radial extending member 223 and the assembling opening 11. Besides, there is an air-guiding passage 221*a* between the radial extending member 223 and the heat sink 21, with the air-guiding passage 221*a* extending in the radial directions of the reference axial line "L" outwards to communicate with the outside of the housing 1.

In accordance with the above "radial inlet and radial outlet" type of the LED lamp, the air channel 4 and air-guiding passage 221*a* are respectively taken as a radial inlet and a radial outlet of the LED lamp, such as the air channel 4 serving as a radial inlet and the air-guiding passage 221*a* serving as a radial outlet, or the air channel 4 serving as a radial outlet and the air-guiding passage 221*a* serving as a radial inlet. For example, as shown in FIG. 4, when the fan wheel 222 is operated, the air outside the housing 1 can be drawn into the receiving room of the housing 1 and the frame 221 through the air channel 4, and further exhausted from the housing 1 by the air-guiding passage 221*a* to carry the heat of the light emitting diode 3 away when passing through the heat sink 21.

Figure 5:
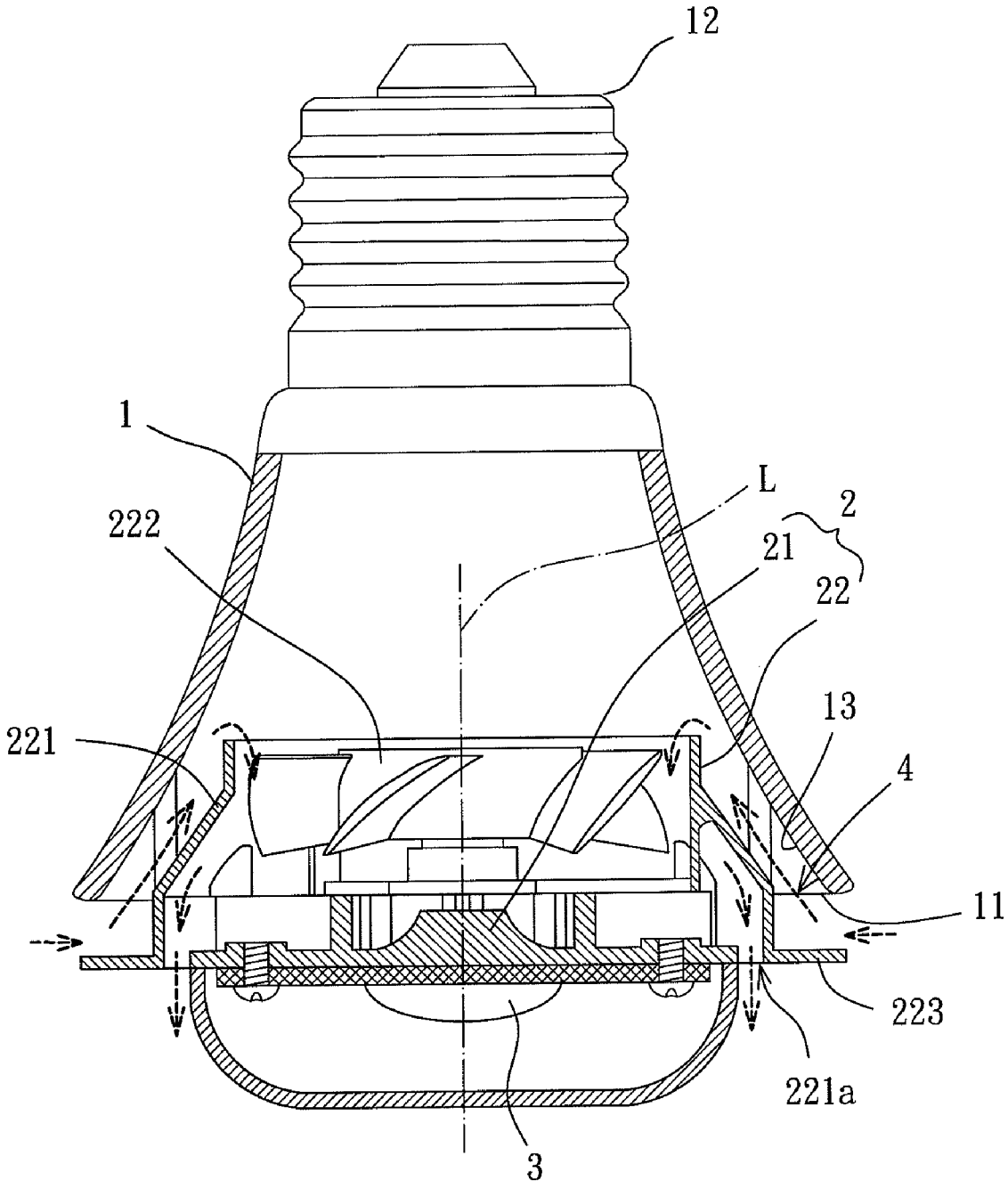
FIG. 5 shows a cross-sectional view of a "radial inlet and axial outlet" type, or an "axial inlet and radial outlet" type, of the LED lamp according to the preferred embodiment of the invention.

Referring to FIG. 5, the said "radial inlet and axial outlet" type of the LED lamp is shown. In this type, the air channel 4 is still formed between the radial extending member 223 and the air-guiding wall 13 as well as by the radial extending member 223 and the assembling opening 11, but the air-guiding passage 221*a* is arranged between an inner periphery of the frame 221 and the heat sink 21. In accordance with the above "radial inlet and axial outlet" type of the LED lamp, the air channel 4 is taken as a radial inlet of the LED lamp, and the air-guiding passage 221*a* is taken as an axial outlet of the LED lamp. Alternatively, when the fan wheel 222 drives the air in the LED lamp to flow in a reverse direction, the "axial inlet and radial outlet" type of the LED lamp is thus provided, with the air-guiding passage 221*a* serving as an axial inlet and the air channel 4 serving as a radial outlet. For example, as shown in FIG. 5, when the fan wheel 222 is operated, the air outside the housing 1 can be drawn into the receiving room of the housing 1 and the frame 221 through the air channel 4, and further exhausted from the housing 1 by the air-guiding passage 221*a* to carry the heat of the light emitting diode 3 away when passing through the heat sink 21. On the other hand, if the fan wheel 222 revolves in a reverse direction, the air outside the housing 1 can be drawn into the receiving room of the housing 1 and the frame 221 by the air-guiding passage 221*a* to carry the heat of the light emitting diode 3 away when passing through the heat sink 21, and further exhausted from the housing 1 through the air channel 4.

Although the air channel 4 can also be arranged for the LED lamp to be a "axial inlet and axial outlet" type, the "axial inlet and axial outlet" type is not preferred since turbulence and circular hot air that is inhaled and exhausted continuously may easily be caused due to the short distance between the axial inlet and axial outlet.

Preferably, the LED lamp further includes a transparent bulb 5. Referring to FIG. 4 again, the transparent bulb 5 couples with the heat sink 21 of the cooling module 2. Furthermore, the transparent bulb 5 can also extend to have a surface facing the assembling opening 11 and air-guiding wall 13 of the housing 1, so as to form a part of the air channel 4. Specifically, the transparent bulb 5 has an opening portion 51 for the light emitting diode 3 to be inserted into the transparent bulb 5 through the opening portion 51. In such an arrangement, light emitted by the light emitting diode 3 may pass through the transparent bulb 5 to the outside of the LED lamp. Therefore, the emitted light of the LED lamp may be changed as long as the color or transparency of the transparent bulb 5 is changed, while the transparent bulb 5 can also protect the light emitting diode 3.

In sum, the LED lamp of the invention does not require forming any air inlet or air outlet on the housing 1 as the air can flow into and out of the housing 1 through the air channel 4 formed between the housing 1 and cooling module 2, so that the LED lamp of the invention has a simplified structure, which provides convenient manufacture and maintains exterior integrity of the LED lamp. Furthermore, when the LED lamp is partially inserted into the decorative ceiling, the air channel 4 can allow the external air to pass through the LED lamp by the cooling module 2 for heat dissipation. Thus, the service life of the LED lamp is prolonged.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. An LED lamp comprising:

a housing having an assembling opening and an electrical connection member on two ends of the housing, wherein an inner surface of the housing defines a receiving room, and a part of the inner surface of the housing adjacent to the assembling opening is an air-guiding wall;

a cooling module disposed at the assembling opening of the housing to form at least one air channel between the cooling module and the air-guiding wall, wherein the cooling module has an air-guiding passage communicating with the receiving room of the housing, wherein the cooling module comprises a heat sink and a cooling fan, with the cooling fan coupled with the heat sink, wherein the cooling fan of the cooling module has a frame, a fan wheel received in the frame, and a radial extending member formed on bottom of the frame, with the at least one air channel formed between the air-guiding wall and the radial extending member, and with the air-guiding passage formed between the radial extending member and the heat sink; and a light emitting diode coupled with the cooling module;

wherein the at least one air channel is at least one radial inlet and the air-guiding passage is a radial outlet, or the at least one air channel is at least one radial outlet and the air-guiding passage is a radial inlet.

2. The LED lamp as claimed in claim 1, wherein an axial line of the cooling fan is defined as a reference axial line of the cooling module, and the radial extending member extends in radial directions perpendicular to the reference axial line.

3. The LED lamp as claimed in claim 1 further comprising a transparent bulb coupling with the cooling module, with the light emitting diode received inside the transparent bulb.

4. The LED lamp as claimed in claim 3, wherein the transparent bulb extends to have a surface facing the assembling opening and air-guiding wall of the housing, so as to form a part of the air channel.

5. An LED lamp comprising:

a housing having an assembling opening and an electrical connection member on two ends of the housing, wherein an inner surface of the housing defines a receiving room, and a part of the inner surface of the housing adjacent to the assembling opening is an air-guiding wall;

a cooling module disposed at the assembling opening of the housing to form at least one air channel between the cooling module and the air-guiding wall, wherein the cooling module has an air-guiding passage communicating with the receiving room of the housing, wherein the cooling module comprises a heat sink and a cooling fan, with the cooling fan coupled with the heat sink, wherein the cooling fan of the cooling module has a frame, a fan wheel received in the frame, and a radial extending member formed on bottom of the frame, with the at least one air channel formed between the air-guiding wall and the radial extending member, and with the air-guiding passage formed between an inner periphery of the frame and the heat sink; and a light emitting diode coupled with the cooling module;

wherein the at least one air channel is at least one radial inlet and the air-guiding passage is an axial outlet, or the at least one air channel is at least one radial outlet and the air-guiding passage is an axial inlet.

6. The LED lamp as claimed in claim 5, wherein an axial line of the cooling fan is defined as a reference axial line of the cooling module, and the radial extending member extends in radial directions perpendicular to the reference axial line.

7. The LED lamp as claimed in claim 5 further comprising a transparent bulb coupling with the cooling module, with the light emitting diode received inside the transparent bulb.

8. The LED lamp as claimed in claim 7, wherein the transparent bulb extends to have a surface facing the assembling opening and air-guiding wall of the housing, so as to form a part of the air channel.

* * * * *